United States Patent [19]

Kimmell

[11] 4,135,645

[45] Jan. 23, 1979

[54] SELF-DEFENSE RING

[75] Inventor: Steven D. Kimmell, Granada Hills, Calif.

[73] Assignee: Mattel, Inc., Hawthorne, Calif.

[21] Appl. No.: 829,711

[22] Filed: Sep. 1, 1977

[51] Int. Cl.[2] ..... A44C 9/00

[52] U.S. Cl. ..... 222/83; 63/1 R; 63/15; 222/78; 239/154; 141/330

[58] Field of Search ..... 63/1, 2, 15; 239/152, 239/153, 154; 222/5, 78, 81, 83; 141/330

[56] References Cited

U.S. PATENT DOCUMENTS

| | | | |
|---|---|---|---|
| 594,595 | 11/1897 | Brethauer | 222/78 X |
| 605,430 | 6/1898 | Humphrey | 222/79 |
| 688,882 | 12/1901 | Parker | 222/79 |
| 2,114,583 | 4/1938 | Adams | 222/83 |
| 2,234,062 | 3/1941 | Roberts | 63/1 |
| 2,385,091 | 9/1945 | Lukowitz | 222/78 X |
| 2,584,087 | 1/1952 | Barbieri | 63/1 |
| 2,699,883 | 1/1955 | Meyers | 222/5 |
| 3,270,525 | 9/1966 | Sellers | 63/1 |
| 3,331,537 | 7/1967 | Benedict | 273/84 R X |
| 3,353,749 | 11/1967 | Lahaug | 239/154 |
| 3,995,447 | 12/1976 | Levsunov | 63/1 R |

*Primary Examiner*—F. Barry Shay
*Attorney, Agent, or Firm*—John G. Mesaros; Max E. Shirk; Ronald M. Goldman

[57] ABSTRACT

A self-defense ring having a ring member with an opening for inserting a finger therethrough and a movable member coupled to the ring member, the movable member having a portion thereof within the opening for manipulation by the finger. The movable member has secured thereto a container having a chemical substance therein, manipulation of the movable member urging the container against a piercing member affixed to or integral with the ring member. A rotary safety is provided to permit actuation of the ring only when desired by the user.

16 Claims, 3 Drawing Figures

FIG. 1
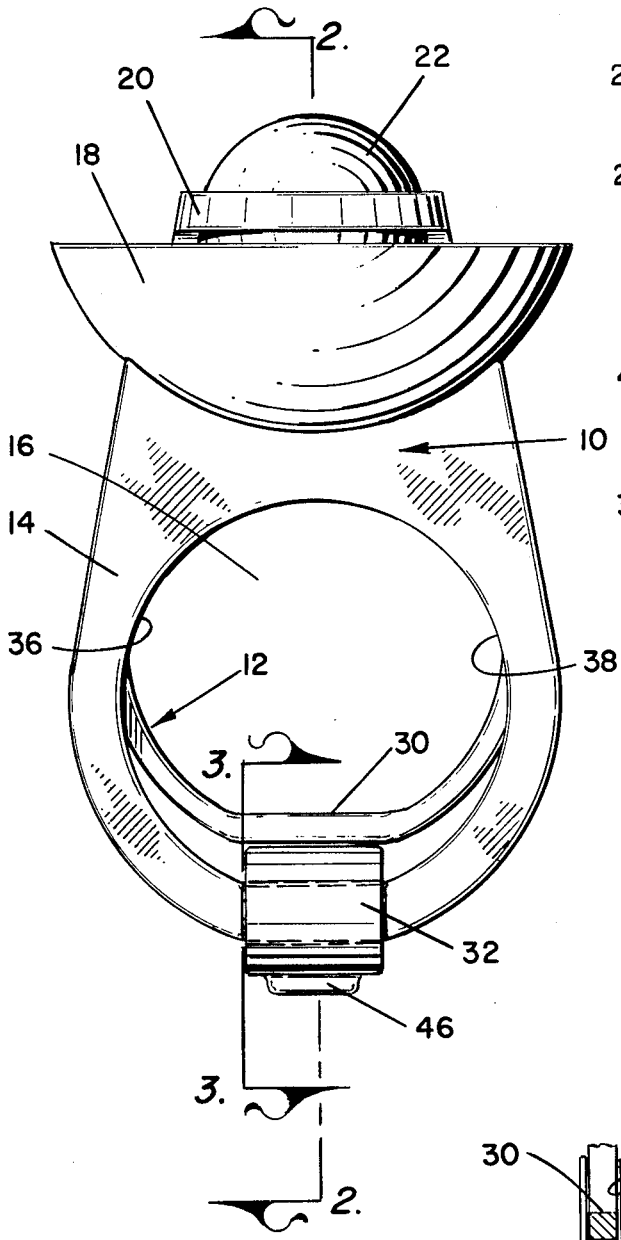
FIG. 2
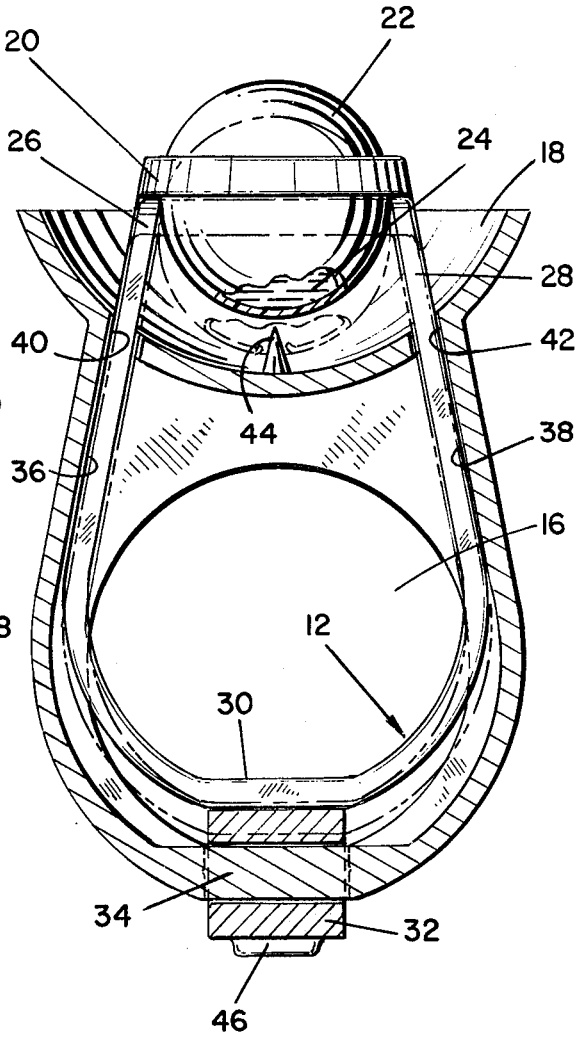
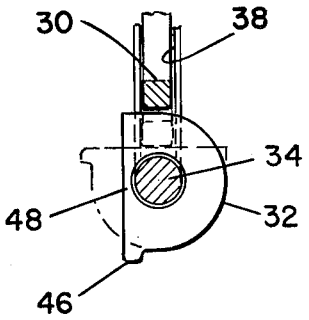
FIG. 3

SELF-DEFENSE RING

BACKGROUND OF THE INVENTION

The background of the invention will be discussed in two parts:

1. Field of the Invention

This invention relates to self-defense devices and more particularly to a self-defense ring for deterring an assailant.

2. Description of the Prior Art

Due to the increase in concern for personal safety due to increasing crime rates, security systems and devices of various types are commercially available for protecting the person or property of the person against theft, assault or the like. With the alarming state of crime against the person, particularly assualts and rapes, with the corresponding concern of law enforcement officers regarding individuals carrying concealed weapons to protect themselves, a need has arisen for self-defense devices which comply with the law when carried or worn by the person seeking protection while simultaneously providing an effective deterrent against the assault or attempted rape.

One such attempt was a device in the form and size of a ballpoint pen, the device including a chemical called "Mace" which was discharged on actuation of the device, the discharge usually being aimed at the assailant's face or eyes. However, in many locales or states the device has been banned.

One of the primary drawbacks associated with such a device is that the hands of the user, or at lesst one hand had to be free to reach for and withdraw the device for use. Another drawback with the device is that it would have to be readily available should the attack occur within the home. Ideally, any such self-defense device, to be practical and readily usable, must be of the type which can be ordinarily worn by the user. Such a device would include, for example, a ring and a defense ring is shown and described in U.S. Pat. No. 3,353,749, the defense ring of this patent including a ring section with an attached sprayer section having a spray nozzle with a spray bulb such as an atomizer or the like filled with a quantity of either pulverized or liquid material for spraying therefrom upon compression of the bulb. The design is such that the bulb fits between the finger on which the ring is worn and the palm of the hand with the clenching of the hand resulting in depression of the bulb. In the device, the spray section is made detachable from the ring so that the wearer is confronted with the situation of attaching the spray section when a possibility of danger threatens. The problem, in this instance, is the same as with the "Mace" device wherein the individual must be aware that the possibility of danger exists in order to retrieve the device and assemble it.

Accordingly, it is an object of the present invention to provide a new and improved self-defense ring.

It is another object of this invention to provide a new and improved self-defense ring which has no obtrusive or aesthetically objectionable components.

It is another object of this invention to provide a new and improved self-defense ring which can be operated by the user with the same hand upon which it is worn.

SUMMARY OF THE INVENTION

The foregoing and other objects of the invention are accomplished by providing a self-defense ring having an opening for inserting a finger therethrough, the ring having a movable member coupled to the ring member with the movable member having a portion thereof extending into the opening for operation by the finger upon which the ring is worn. One of the ring member and the movable member is provided with a container such as a glass or plastic ampule having a chemical substance therein for emitting a noxious odor. The other of the ring member and movable member is provided with a piercing member adjacent the container for piercing the container in response to relative movement between the parts. A cam member is coupled to one of the two members for rotation, the cam member having a first position preventing movement between the parts and a second position permitting movement between the parts. The cam member is configured for actuation by a thumb or other finger of the same hand on which the ring is worn.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 1 is a front view of the self-defense ring according to the invention;

FIG. 2 is a cross-sectional front view of the ring of FIG. 1; and

FIG. 3 is a cross-sectional view of the ring taken along line 3—3 of FIG. 1.

DESCRIPTION OF THE PREFERRED EMBODIMENT

Referring now to the drawings and particularly to FIG. 1, there is shown a self-defense ring including a primary ring member generally designated 10 and a secondary movable member generally designated 12 fitted within the primary ring member 10. The ring member 10 is configured in an aesthetically pleasing fashion and having a main finger engaging portion 14 with an opening 16 therein for passage of a finger therethrough. The upper portion of ring member 10 is provided with a generally bowl-shaped portion 18 which, as shown, is spherically contoured and affixed to or integral with the finger engaging portion 14. Extending upwardly from the bowl-shaped portion 18 is an annular member 20 having affixed within the opening thereof a spherical container means 22 which may be formed, for example, of a plastic or glass material having sufficient rigidity to withstand normal wear and tear while still being penetrable. The container 22 can be colored in any suitable color to provide an appearance similar to well known cosmetic jewelry stones to thereby provide an aesthetically pleasing appearance, while concealing the existence of a self-defense ring.

Referring also to FIG. 2, the supporting of the container 22 by the annular ring member 20 will be discussed in detail. As can be seen, the container 22 contains a chemical substance 24 within the hollow interior thereof. The annular member 20 has an inner periphery conforming to a portion of the surface of the spherical container 22 with the lower rim of annular member 20 being spaced slightly above the center of container 22 to thereby engage the sphere of container 22 in such a manner that downward movement thereof will not dislodge the container 22. The annular member 20 is secured at diametrically opposite points to the movable member 12 which is generally U-shaped or horseshoeshaped with the free ends 26 and 28 thereof secured to the annular member 20. The curved bight portion 30 of the movable member 12 has a smaller radius than the radius of finger engaging portion 14 with the opening 16 in the solid line position shown in FIG. 2 being sufficient for passage of a finger therethrough. The bight portion 30 of movable member 12 is maintained in spaced relation to the adjacent surface of finger engaging portion 14 by means of a rotary safety in the form of a D-shaped cam member 32 rotatably coupled to a circular portion 34 of the finger engaging portion 14 to prevent accidental movement of member 12. The member 12 is slidably or movably positioned within ring member 10 by means of channels 36 and 38 formed on the interior of ring member 10, the channels 36 and 38 being in general alignment with each other in a generally common plane which is generally intermediate opposing surfaces of finger engaging portion 14, the opposing surfaces generally having a thickness therebetween of about the same thickness as a conventional ring ordinarily worn by a person.

The ends 26 and 28 which are remote from bight 30 of movable member 12 extend through apertures 40 and 42, respectively, formed at the junction of channels 36 and 38, respectively, in the bowl-shaped portion 18. Centrally disposed within bowl-shaped portion 18 and integral therewith or affixed thereto, is a firing pin or piercing member 44, the piercing member 44 being generally conically configured and perpendicular to a tangent on the surface of the spherical container 22. The piercing member 44 has a tip thereof in spaced proximate relation to the surface of container 22 with the overall height of piercing member 44 being sufficient to provide full penetration through the surface of container 22 when the self-defense ring is operated as will hereinafter be discussed. In addition to the aesthetically pleasing appearance of the bowl-shaped portion 18, the portion 18 serves as a receptacle for the chemical substance 24 so-released, with a relatively broad receptacle area facilitating evaporation or chemical reaction of the chemical substance 24 into the atmosphere to emit the noxious odor rapidly.

As illustrated in FIGS. 1-3, the D-shaped cam, in order to facilitate rotation thereof, is provided with a downwardly depending projection 46 which is configured for contact by the edge of a thumb or finger to permit rotation to the dotted line position shown in FIG. 3 at which time the planar surface 48 of the cam member 32 is in the path of travel between the bight portion 30 of movable member 12 and the circular portion 34 of the finger engaging portion 14 of the ring member 10. Thus, the bight portion 30 can be urged toward the ring member 10 to cause movable member 12 to travel downwardly as viewed in FIG. 2 to the dotted line position thereby permitting the container 22 to be urged toward the piercing member 44 to thereby discharge the chemical substance 24 therein.

In operation, the self-defense ring would normally be worn on the ring finger of the person with the safety on, that is, with the cam member 32 in the solid line position shown in FIGS. 1-3. In this position, a container 22 will be spaced from the tip of piercing member 44, and to all outward appearances, with the parts thereof configured properly and of proper materials, the self-defense ring will appear as an item of normal costume jewelry. With the assailant attacking the user from a point of concealment, even if the assailant grabs one or both arms, the wearer of the ring, utilizing the thumb on the same hand on which the ring is worn, can rotate the cam 32 to the dotted line position shown in FIG. 3 and in one sweeping move can urge the fingers toward the palm to provide relative movement between the movable member 12 and the ring member 10 to thereby cause the capsule 22 to be pierced by piercing member 44, thus discharging the chemical contents 24 in the general direction preferably toward the face of the assailant.

While many chemical substances can be utilized within the container 22, in the preferred embodiment a chemical emitting a noxious odor equivalent to a fecal smell is used. The chemicals of this type, while providing an imediate deterrent to an attacker intent on rape, also provides a means whereby an assailant captured within a certain time period will be readily identifiable. Any chemical utilized must meet federal regulations regarding toxicity, ocular reactions and dermal reactions in order to be approved for uses in such devices. Additionally, to be effective, it is preferable that the chemical substance 24 be a volatile chemical which provides an immediate discharge into the surrounding environment. Such chemicals include, for example, iso-butyric acid and valeric acid. Other chemicals may include, for example, a solution of skatol (3-methyl-1 H-Indole) or 2-methyl-2 propanethiol. In addition, other chemicals obviously would be suitable, even though not of the noxious odor type and it is intended that various chemical substances for different purposes can be likewise utilized in the self-defense ring according to the invention, such chemicals preferably being of the volatile type to provide an immediate reaction and deterrent to an assailant.

The self-defense ring according to the invention is simple, compact, readily operable by a digital member on the same hand on which the ring is worn and requires no advance knowledge of a possible threat of danger for its effectivity. A safety is provided to prevent accidental discharge of the chemical substance with the chemical substance being contained in a suitable container or ampule of sufficient rigidity to protect against accidental breakage thereof. Furthermore, the container can be colored in an aesthetically pleasing fashion to conform to well known gems or stones to disguise the existence of the ring as a self-defense device.

Furthermore, although the description has proceeded with reference to the container 22 being movable relative to a piercing member, the ring can be readily constructed with the container member securely coupled to the ring member with the movable member having affixed thereto the piercing member. Likewise, the movable member 30 need not encircle the ring finger, but may be, for example, in the form of a conventional trigger member pivotally mounted to the ring member to provide the necessary actuation. While there has been shown and described a preferred embodiment, it is to be understood that various other adaptations and modifications may be made within the spirit and scope of the invention.

What is claimed is:

1. In a ring to be worn on the finger of a person for deterring an assailant, the combination comprising:

a ring member having an opening for inserting a finger therethrough;

a member coupled to said ring member in relatively movable relation thereto;

container means having a chemical substance therein, said container means being secured to one of said ring member and said movable member; and piercing means carried by the other of said ring member and said movable member for piercing at least a portion of said container means in response to relative movement between said ring member and said movable member, said movable member being positioned and configured for actuation by the person wearing the ring, using the same hand on which the ring is worn.

2. The combination according to claim 1 wherein said movable member has a portion thereof extending into said opening, said movable member being actuated toward the periphery of said opening by movement of the finger toward the palm of the hand.

3. The combination according to claim 2 wherein said movable member is a framework slidably mounted on said ring member, said framework having a portion thereof configured for engagement by the finger of the user.

4. The combination according to claim 3 wherein said ring further includes means mounted on said ring member for actuation between a first and second positions, said first position preventing movement of said movable member and said second position permitting movement of said movable member.

5. The combination according to claim 4 wherein said container means is carried by said framework and said piercing means is integral with said ring member in the path of movement of said container means.

6. The combination according to claim 5 wherein said framework includes a generally U-shaped member slidably mounted within said ring member.

7. The combination according to claim 6 wherein said means operable between said first and second positions is a cam member rotatably mounted on said ring member.

8. The combination according to claim 7 wherein said ring member further includes a generally bowl-shaped portion in proximate relation to said container means for at least partially receiving said chemical substance upon piercing of said container means whereby to facilitate evaporation thereof.

9. The combination according to claim 8 wherein said piercing means is a piercing member generally centrally disposed within said bowl-shaped portion of said ring member.

10. In a ring to be worn on the finger of a person for deterring an assailant, the combination comprising:

a ring member remote from the bight thereof having an opening for inserting a finger therethrough, said ring member having an enlarged bowl-shaped portion;

a generally U-shaped member slidably mounted on said ring member, the ends of said U-shaped member extending into said bowl-shaped portion;

container means having a chemical substance therein, said container means being secured to one of said bowl-shaped portion and said ends; and piercing means secured to the other of said bowl-shaped portion and said ends, said piercing means being in spaced proximate relation to said container means for piercing at least a portion of said container means in response to relative movement between said ring member and said U-shaped member.

11. The combination according to claim 10 wherein said chemical substance is a volatile chemical emitting a noxious odor.

12. The combination according to claim 11 wherein said chemical substance contains iso-butyric acid.

13. The combination according to claim 11 wherein said chemical substance contains a solution of 3-Methyl-1 H-indole.

14. The combination according to claim 11 wherein said chemical contains valeric acid.

15. The combination according to claim 11 wherein said chemical contains 2-methyl-2-propanethiol.

16. The combination according to claim 11 wherein said container means is a spherical container secured to said ends of said U-shaped member and said piercing means is a piercing member generally centrally disposed within said bowl-shaped portion.

* * * * *